US005154255A

United States Patent [19]

Kiska et al.

[11] Patent Number: 5,154,255

[45] Date of Patent: Oct. 13, 1992

[54] LADDER SHOE AND METHOD OF USE

[75] Inventors: Stanley A. Kiska, Greenville; Richard P. Sulecki, Transfer, all of Pa.

[73] Assignee: R. D. Werner Co., Inc., Greenville, Pa.

[21] Appl. No.: 738,879

[22] Filed: Aug. 1, 1991

[51] Int. Cl.[5] ..... E06C 7/42

[52] U.S. Cl. ..... 182/111

[58] Field of Search ..... 182/108, 111, 109

[56] References Cited

U.S. PATENT DOCUMENTS

| | | | |
|---|---|---|---|
| 1,973,226 | 9/1934 | Rose | 182/109 |
| 2,309,484 | 1/1943 | Van Meter | 182/109 |
| 2,691,479 | 10/1954 | Sharp | 182/109 |
| 3,456,757 | 7/1969 | Sain | 182/111 |

*Primary Examiner*—Reinaldo P. Machado
*Attorney, Agent, or Firm*—Ansel M. Schwartz

[57] ABSTRACT

A ladder shoe for providing enhanced stability between a ladder and a variety of surfaces. The ladder shoe is comprised of a shoe body having a first side plate, a second side plate and a base. The first side plate and the second side plate are attached to the base. The side plates include curved slots through which a fastener is disposed which movably connects the ladder shoe to the end of the ladder's side rail, thereby allowing the ladder shoe to move between a first position where the base is at a first angle with respect to the side rail and a second position where the base is at a second angle with respect to the side rail. Each slot has a notch in which the fastener catches causing the shoe to be maintained in an intermediate position until the shoe body is desired to be placed into another position. The base has a bottom which provides a slip resistant surface for engaging the shoe body to essentially flat surfaces when the shoe body is in the first position. Preferably, a spur plate is provided for engaging the shoe with penetrable surfaces when the shoe body is in a second position extending from the base. There is also a method and system involving the same.

17 Claims, 5 Drawing Sheets

LADDER SHOE AND METHOD OF USE

FIELD OF THE INVENTION

The present invention relates to ladders. More specifically, the present invention relates to a positionable ladder shoe having a notch for holding it in an intermediate position relative to the ladder.

BACKGROUND OF THE INVENTION

Ladders are commonly used for climbing up or down from one given level to another. Their most typical construction consists essentially of two long vertically oriented runners, known as side rails, separated and joined at intervals by cross pieces, known as rungs, on which to step. The origin of the word ladder comes from the old English word hlinian which simply means to lean. This obviously relates to the fact that ladders are commonly leaned on a wall or the like. In terms of physics, the angle of this lean, or angle of inclination, translates a portion of the vertical force, resulting from the combined weight of the ladder and user, into a horizontal component which tends to push the bottom of the ladder away from the wall. If this force is not balanced by an opposite force, typically friction, then the ladder will slide out from the wall against which it is leaning. It is obvious why this event must be avoided.

It is known in the prior art to add ladder shoes to the ends of a ladder's rails to increase traction. It is common to construct ladder shoes such that they can pivot, slide or rotate about the ends of the rail into two positions. The first position typically engages the ladder shoe flat against a surface. The second position typically engages the ladder shoe such that a spur plate of the shoe is aligned in parallel with its side rail so that it can engage with a penetrable surface such as grass and securely maintain the ladder thereon. In the past, it has been an inefficient ordeal to hold the ladder off of the ground while trying to move and hold the ladder such that the spur plate is disposed to properly penetrate into grass or the like.

Applicant's invention overcomes this problem by providing a ladder shoe that can be easily positioned and maintained in an intermediate position such that as the ladder is lowered into engagement with the ground, the ladder shoe is naturally urged into the second position. If it is desired to disengage the ladder shoe from the intermediate position, the ladder shoe need only be nudged.

SUMMARY OF THE INVENTION

A ladder shoe for providing enhanced stability between a ladder and a variety of surfaces. The ladder shoe is comprised of a shoe body having a first side plate, a second side plate and a base. The first side plate and the second side plate are attached to the base. The side plates include curved slots through which a fastener is disposed which movably connects the ladder shoe to the end of the ladder's rail, thereby allowing the ladder shoe to move between a first position where the base is at a first angle with respect to the side rail and a second position where the base is at a second angle with respect to the side rail. Each slot has a notch in which the fastener catches causing the shoe to be maintained in an intermediate position where the base is at an intermediate angle between the first angle and the second angle with respect to the side rail until the shoe body is desired to be placed into another position with respect to the side rail. The base has a bottom which provides a slip resistant surface for engaging the shoe body to essentially flat surfaces when the shoe body is in the first position and the shoe body has a spur plate extending from the base for engaging the shoe body with penetrable surfaces when the shoe body is in the second position.

The present invention also pertains to a method for going from a first location at a first height to a second location at a second height. The method comprises the steps of lifting a ladder into the air. Then, there is the step of holding the ladder having ladder shoes attached to side rails of the ladder at the bottom thereof. The ladder shoes each have a spur plate and a base and are movably connected to the side rails such that each shoe can move between a first position where the base is at a first angle with respect to the respective side rail and a second position where the base is at a second angle with respect to the respective side rail. Next, there is the step of moving the ladder shoes about the bottom of the respective side rails until they are fixedly maintained in an intermediate position where the base is at an intermediate angle between the first angle and the second angle. Next, there is the step of positioning a ladder over a desired support surface. Then, there is the step of displacing the ladder shoes while holding the ladder above the support surface so that they fall form the intermediate position. Next, there is the step of lowering the ladder towards the support surface such that the ladder shoe is moved to the first position in which the ladder is supported on the support surface through the base of the ladder shoe. Next, there is the step of lifting the ladder into the air. Then, there is the step of moving the ladder shoes about the bottom of the side rails until they are maintained in the intermediate position. Next, there is the step of positioning the ladder over a desired location of a penetrable support surface. Then, there is the step of towering the ladder downward towards the penetrable surface such that the spur plates move the ladder shoes into the second position and penetrate into the penetrable surface.

The present invention also pertains to a system for going from a first location at a first height to a second location at a second height. The system comprises a ladder having a first side rail and an opposing second side rail with rungs disposed therebetween and in contact therewith maintaining the side rails in spaced relationship. The system is also comprised of a first and second ladder shoe. Each shoe has a base and a spur plate which extends from the base. The first and second shoes movably connect to the first and second side rails, respectively, such that each shoe can move between a first position where the base is at a first angle with respect to the respective side rail, and a second position where the base is at a second angle with respect to the respective side rail. Each shoe can be maintained in an intermediate position where the base is at an intermediate angle between the first angle and the second angle with respect to the respective side rail when the ladder is not in contact with a support surface so that when the ladder is lowered towards a support surface, side rails first, each spur plate contacts the support surface and moves the shoe to the second position so that it can be inserted into the support surface to support the ladder, or when each shoe is displaced from the intermediate position while the ladder is held above the support surface, the shoe falls such that when the ladder is lowered, it is supported on the support surface with the shoe in the first position.

BRIEF DESCRIPTION OF THE DRAWINGS

In the accompanying drawings, the preferred embodiment of the invention and preferred methods of practicing the invention are illustrated in which.

DESCRIPTION OF THE PREFERRED EMBODIMENT

Figure 1:
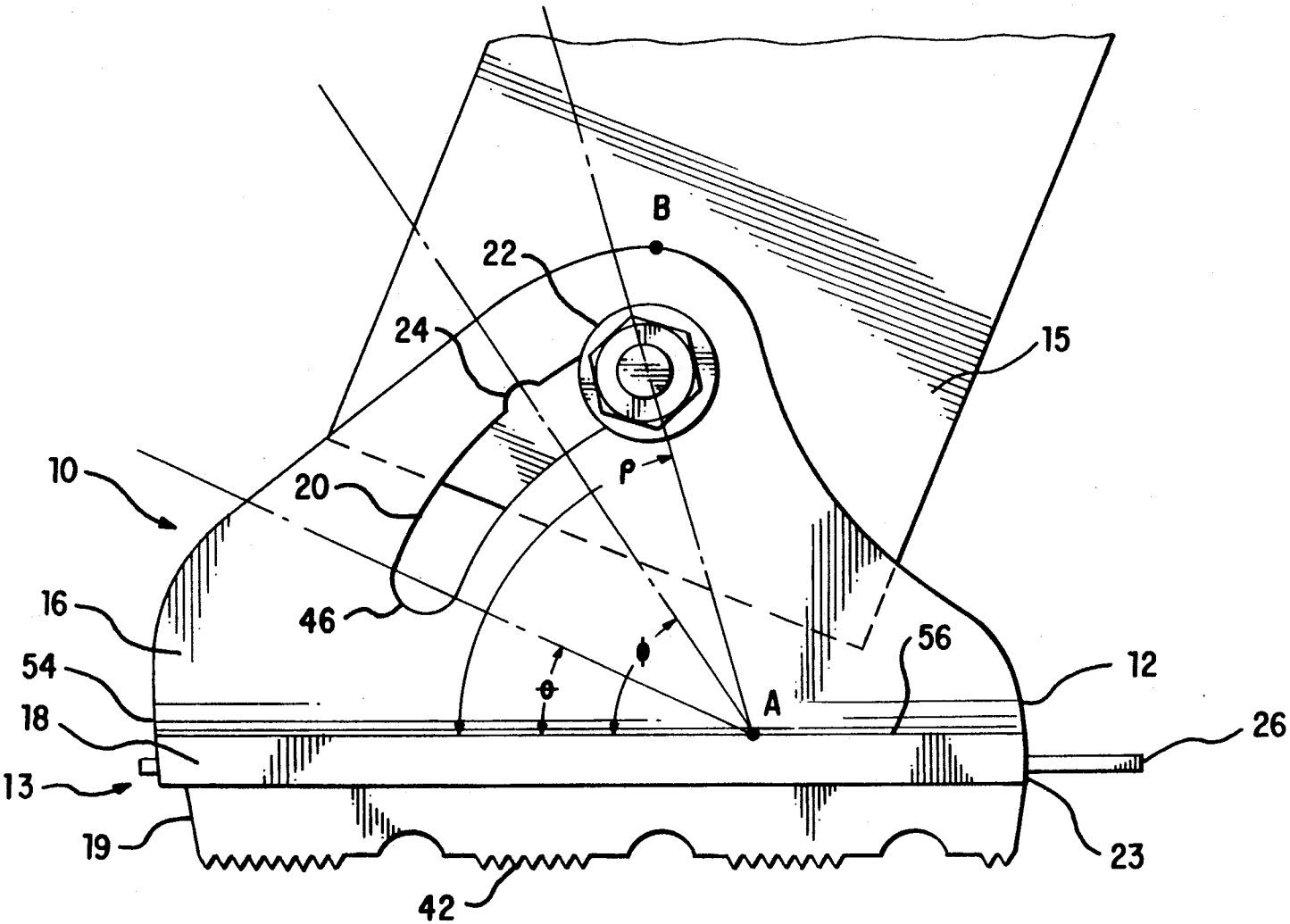
FIG. 1 is a schematic representation showing a side view of the ladder shoe.
Figure 2:
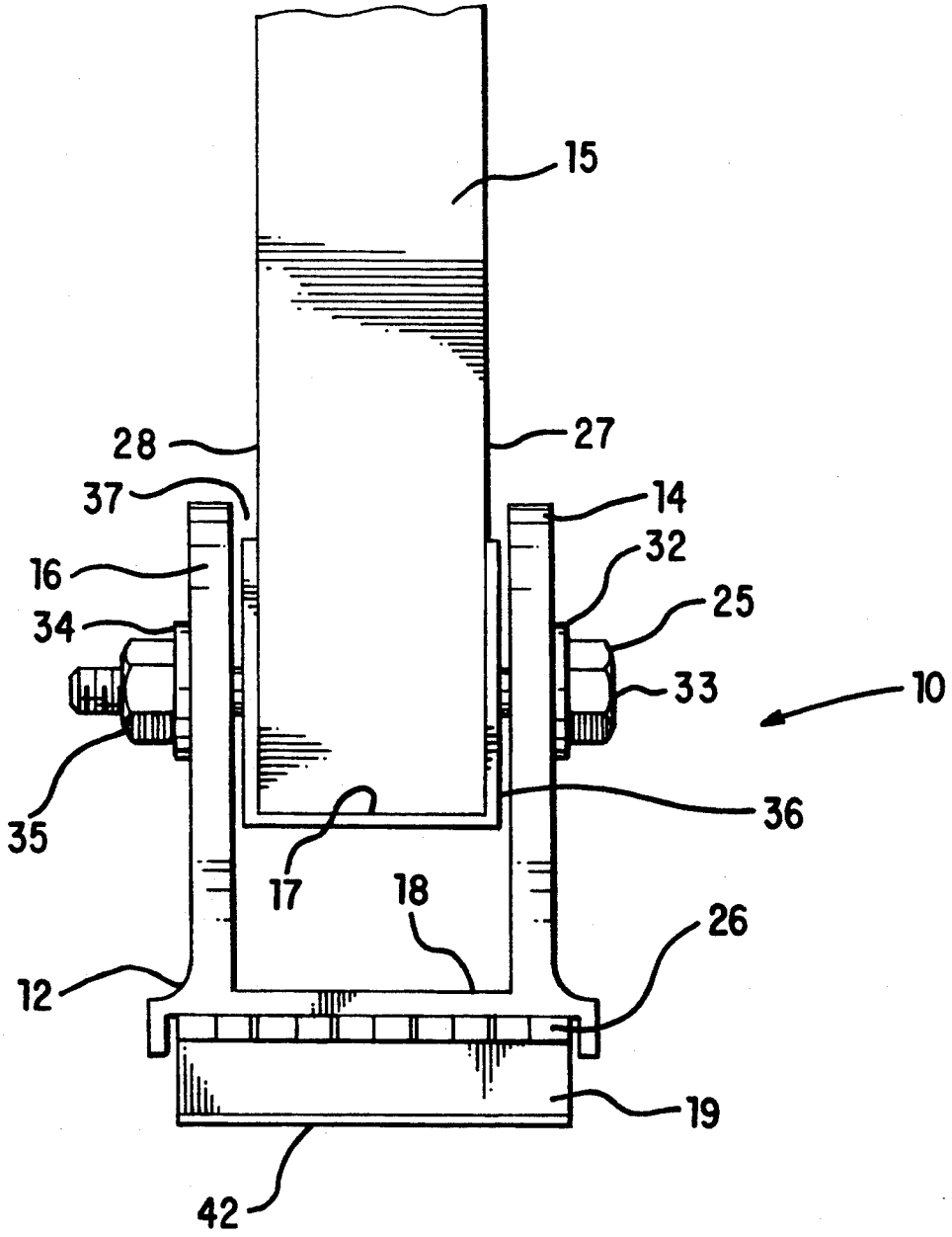
FIG. 2 is a schematic representation showing an end view of the ladder shoe.

Referring now to the drawings wherein like reference numerals refer to similar or identical parts throughout the several views, and more specifically to FIG. 1 thereof, there is shown a schematic representation of a ladder shoe 10. The ladder shoe 10 is comprised of a shoe body 12, having a first side plate 16, a second side plate 14 and a base 18. Each of the side plates 14, 16 have curved slots 20 through which a fastener assembly 22 is disposed. The fastener assembly 22 movably and preferably slidably and rotatably connects the shoe body 12 to the end 17 of a ladder's side rail 15, as shown in FIG. 2. The slots 20 allow the shoe body 12 to move about the end 17 of the ladder's side rail 15 to either a first position or a second position. Each slot 20 has a notch 24 in which the fastener catches causing the shoe body 12 to be maintained in an intermediate position until the shoe body 12 is desired to be placed into another position. The base 18 has a bottom 13 which provides a slip resistant surface 42 for engaging the shoe body to essentially flat surfaces when the shoe body 12 is moved to the first position. Preferably, the bottom 13 of the base 18 includes a foot pad 19 fixedly attached to the base 18 Which provides the slip resistant surface 42 for engaging the ladder shoe 10 to solid surfaces when the ladder shoe 10 is moved to the first position.

Figure 3:
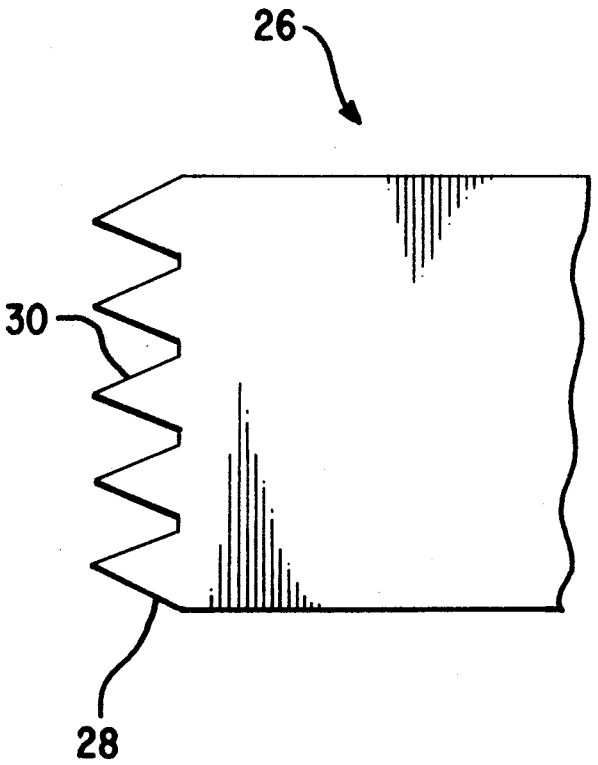
FIG. 3 is a schematic representation showing the spur plate.

Preferably, there is a spur plate 26 fixedly attached to the base 18 cf the shoe body 12 which extends from the base 18 at its front face 23 in an essentially parallel fashion with the bottom 13 of the base 18. The spur plate 26 is comprised of a spur 28 for engaging the ladder shoe 10 with a penetrable surface, such as dirt or grass, when the ladder shoe 10 is rotated into a second position. Preferably, the spur 28 is formed from a series of triangular projections 30 arranged in a sawtooth pattern as shown in FIG. 3.

In a more detailed description and as shown in FIG. 2, the shoe body is comprised of aluminum although essentially any suitable material is acceptable and is in general of the type found in R. D. Werner Co., Inc. Series D1500 ladders. Side plates 14, 16 extend upwardly from the base 18 and preferably form a curved profile essentially covering the entire length of base 18. The ladder shoe 10 is pivotally and slidingly connected to the side rail 15 with a fastener assembly 22 that includes a retaining bolt 25. The retaining bolt 25 extends through the side rail in proximity to the bottom end 17 of the side rail 15 and maintains the ladder shoe 10 in position relative to the side rail 15.

The retaining bolt 25 extends through the side rail 15 and also extends through the side plates 14, 16 such that side plates 14 and 16 sandwich the side rail 15 therebetween. Fastener assembly 22 further includes a washer 32 disposed between side plate 14 and retaining bolt head 33, washer 34 disposed between side plate 16 and locking nut 35 of the fastener assembly 22. The purpose of the washers 32, 34 is to facilitate movement of the ladder shoe 10 relative to the side rail 15. A plastic spacer 36 fits over the bottom end 17 of the side rail 15 and extends up therefrom beyond the position where the retaining bolt 25 extends through the side rail 15. The spacer 36 serves to limit the gap 37 between the side rail 15 and the side plates 14, 16.

Figure 4B:
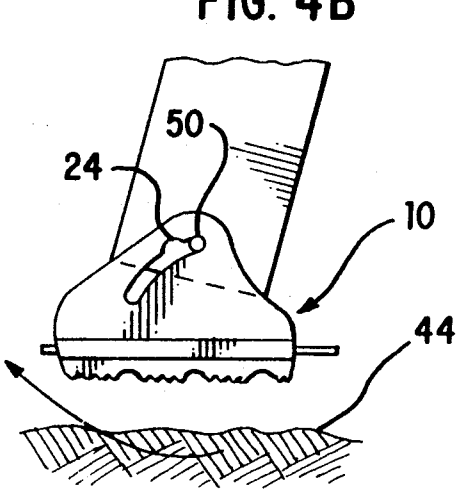
FIGS. 4A-4F are schematic representations showing the ladder shoe in various position about the ends of a ladder.
Figure 4A:
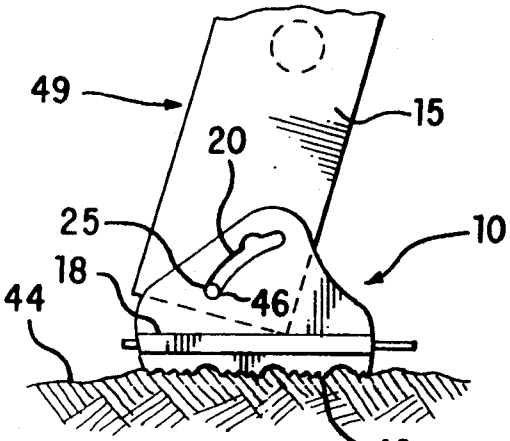

In the operation of the preferred embodiment and as shown in FIGS. 4A-4F, when the ladder 49 is placed on a floor 44 or driveway, the ladder shoe 10 is moved to a first position with the slip resilient surface 42 flush against the floor 44, as shown in FIG. 4A. The ladder 49 under its weight moves relative to the ladder shoe 10 such that the retaining bolt 25 is at first end 46 of the slot 20 of each plate 14, 16, which is close to or at the lowest position of the slot 20 when the ladder shoe 10 is in the first position. In this first position, the bottom end 17 of the ladder's side rail 15 rests upon the base 18 of the shoe body 12. Thus, the retaining bolt 25 does not necessarily support the load of the ladder 49.

Figure 4C:
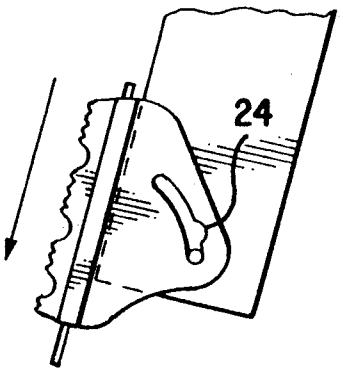
Figure 4F:
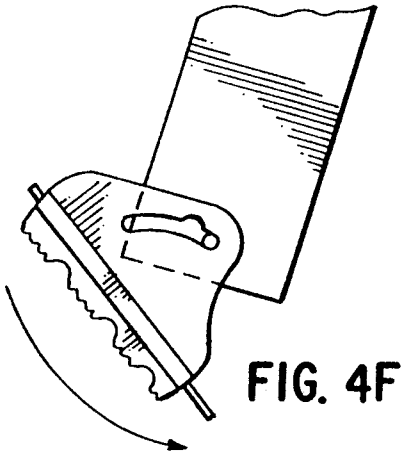
Figure 4E:
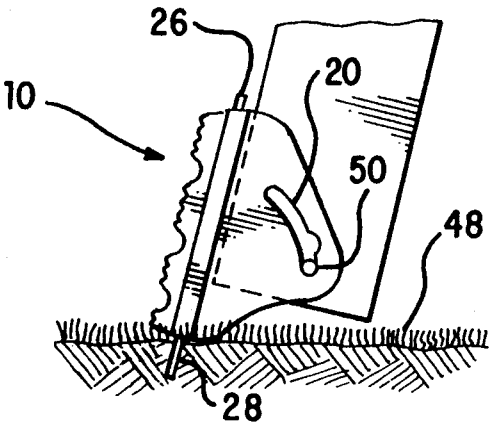
Figure 4D:
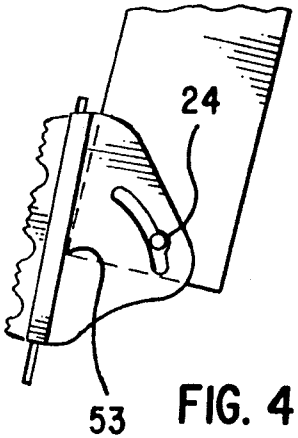

When it is desired to move the ladder 49 to a penetrable surface such as grass 48, the ladder 49 is lifted from the floor 44. The ladder shoe 10, once free from the floor 44, falls under its own weight, sliding along the retaining bolt 25 until the retaining bolt 25 rests against the second end 50 of the slot 20 of each plate 14, 16, as shown in FIG. 4B. The user then rotates the ladder shoe 10 in the direction of the arrow around the end 17 of the side rail 15 until the ladder shoe 10 is positioned, as shown in FIG. 4C (this is easily done with one's foot). In this position, the ladder shoe 10 falls under its own weight until the retaining bolt 25 catches in the notch 24 of each plate 14, 16, as shown in FIG. 4D. The ladder shoe 10 then pivots about the retaining bolt 25 until the base 18 contacts the edge 53 of the ladder's side rail 15 and rests thereagainst. In this intermediate position, the ladder shoe 10 is stable about the end 17 of the side rail 15. The ladder 49 is then carried to the grass 48 as the ladder shoe 10 is conveniently held in this intermediate position.

Once a suitable location is picked, the ladder's side rails 15 are thrust towards the grass 48. As contact is made with the ground, the ladder shoe 10 is caused to dislodge from the notch 24 of each plate 14, 16 and to slide relative to the retaining bolt 25 until the retaining bolt 25 contacts the second end 50 of the slot 20 of each plate 14, 16. Once reaching this second position, as shown in FIG. 4E, the spur 28 of the spur plate 26 can be further inserted into the grass 48 by pushing the side rail 15 downward. The triangular projections 30 of the spur 28 project into the penetrable grass 48 thereby immobilizing the ends of the ladder 49. In the second position, the load of the ladder 49 rests directly upon the second end 50 of the curved slot 20 of each plate 14, 16. Thus, the retaining bolt 25 is a load bearing member.

When it is desired to move the ladder 49 in the grass 48, the ladder 49 is pulled upwards, thereby dislodging the spur 28 from the grass 48. Once free, the ladder shoe 10 can slide along the respective slot 20 until the retaining bolt 25 once again catches in the notch 24. From there, the ladder can be repositioned in the grass, as described above. Or, if it is desired, by pulling back horizontally at the bottom of the ladder 49, the ladder shoes 10 will pivot about the tips of the spur plates 26 back onto their slip resistant surfaces 42.

Figure 5A:
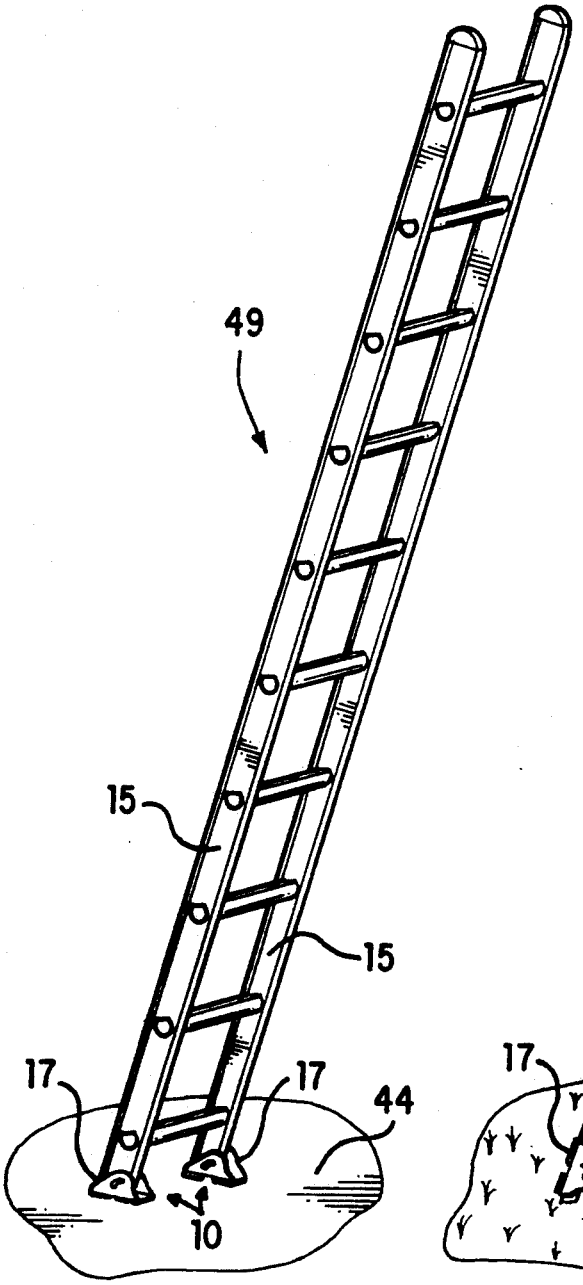
FIGS. 5A-5B are schematic representations showing the ladder shoe on a ladder in two different positions.
Figure 5B:
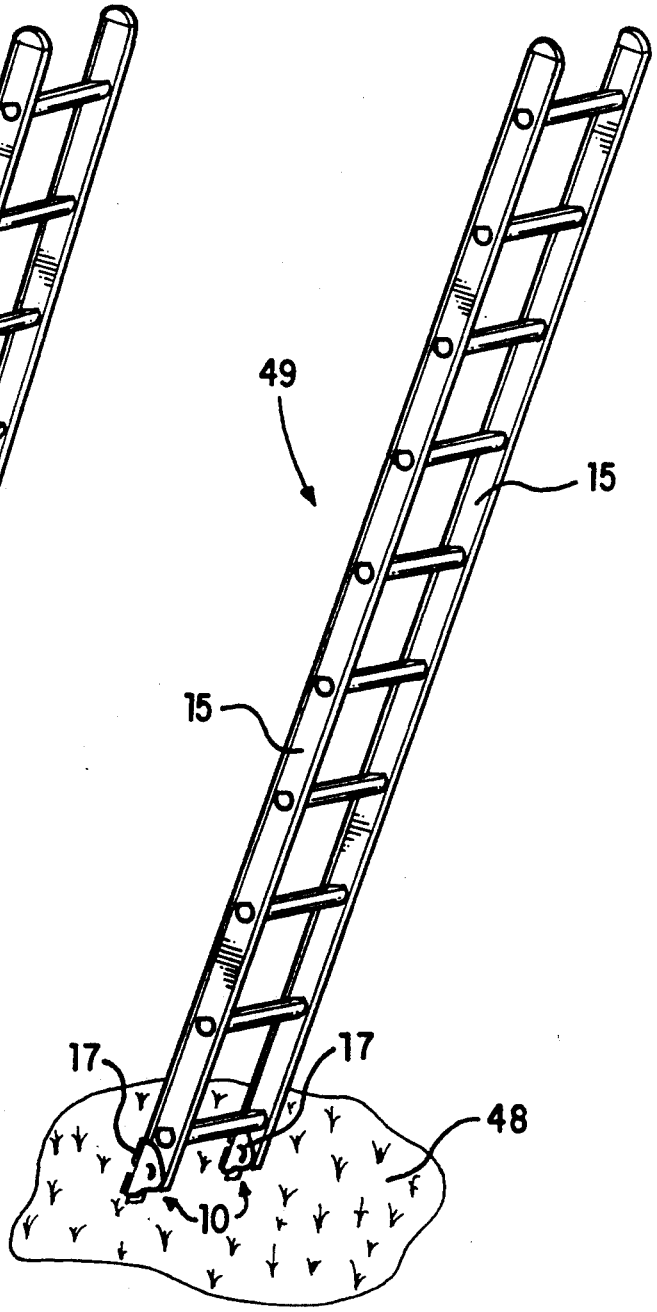

FIGS. 5A–5B show a complete ladder 49 having a pair of ladder shoes 10 disposed at the bottom ends 17 of the side rails 15. FIG. 5A shows the ladder shoes 10 oriented in the first position engaging floor 44. FIG. 5B shows the ladder shoes 10 oriented in the second position, spurs engaged with grass 48.

Referring back to FIG. 1, the geometry of the ladder shoe 10 is described. Point A represents the center of the notch's 24 arc. Point A is located 1.81 inches from the front face 23 of the base 18. Angle $\theta$, associated with the first end 46, is located 25° from the horizontal line 56 of the base 18. The angle $\phi$, associated with the notch 24, is located 55° from the horizontal line 56 of the base 18. Angle $\rho$, associated with the second end 50, is located 76° from the horizontal line 56 of the base 18. The arc length of the slot 20 is thus 51° $(\rho-\theta)$. The spur plate 26 is 6.25 inches long and projects 0.6 inches from the front face 23. The overall height of the ladder shoe 10 from the slip resistant surface 42 to Point B is 3.25 inches. The overall length of the shoe body 12 from the front face 23 to the back face 54 is 5.6 inches.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A ladder shoe for providing enhanced traction between a ladder and a variety of surfaces comprising:

a shoe body having a first side plate, a second side plate and a base, said first side plate and said second side plate attached to the base, said side plates having curved slots through which a fastener is disposed which movably connects the shoe body to an end of a ladder's side rail, thereby allowing the shoe body to move between a first position where the base is at a first angle with respect to the side rail and a second position where the base is at a second angle with respect to the side rail, each slot having a notch in which the fastener catches causing the shoe body to be maintained in an intermediate position where the base is at a second angle with respect to the first angle and the second angle with respect to the side rail until the shoe body is desired to be placed into another position with respect to the side rail, said base having a bottom which provides a slip resistant surface for engaging the shoe body to essentially flat surfaces when the shoe body is in the first position and said shoe body having a spur plate extending from the base for engaging the shoe body with penetrable surfaces when the shoe body is in the second position.

2. A ladder shoe as described in claim 1 wherein each curved slot has a firs side which is closer to the base than a second side of the slot and said notch is disposed on said second side.

3. A ladder shoe as described in claim 1 wherein the shoe body slidably and rotatably moves in the slot between the first position and second position.

4. The ladder shoe as described in claim 3 wherein the bottom of the base includes a footpad fixedly attached to the base which provides a slip resistent surface for engaging the shoe body to essentially flat surfaces when the shoe body is moved to the first position.

5. A ladder shoe as described in claim 4 wherein the intermediate position is very close to the second position.

6. A ladder shoe as described in claim 5 wherein the fastener assembly includes a bolt, lock nut, and two washers.

7. A ladder shoe as described in claim 6 wherein the spur plate is comprised of a series of triangular projections disposed in a sawtooth pattern.

8. A ladder shoe as described in claim 7 wherein the shoe body is made of aluminum.

9. A system for going from a first location at a first height to a second location at a second height comprising:

a ladder having a first side rail and an opposing second side rail with rungs disposed therebetween and in contact therewith maintaining the side rails in spaced relationship; and a first and second ladder shoe, each shoe having a base and a spur plate which extends from the base, the first and second shoes movably connected to the first and second side rails, respectively, such that each shoe can move between a first position where the base is at a first angle with respect to the respective side rail, and a second position where the base is at a second angle with respect to the respective side rail, each shoe can be maintained in an intermediate position where the base is at an intermediate angle between the first angle and the second angle with respect to the respective side rail when the ladder is not in contact with a support surface so that when the ladder is lowered towards a support surface side rails first, each spur plate contacts the support surface and moves its shoe to the second position so that it can be inserted into the support surface to support the ladder, or when each shoe is displaced from the intermediate position while the ladder is held above the support surface, the shoe falls such that when the ladder is lowered, it is supported on the support surface with the shoe in the first position.

10. A system as described in claim 9 wherein each shoe has a first side plate and a second side plate attached to the base, said side plates having curved slots through which a fastener is disposed which movably connects each shoe to an end of the ladder's rail, each slot having a notch in which the fastener catches causing the shoe to be maintained in said intermediate position.

11. A system as described in claim 10 wherein each curved slot has a first side which is closer to the base than a second side of the slot and said notch disposed on said second side.

12. A system as described in claim 11 wherein the intermediate position is very close to the second position.

13. A system as described in claim 12 wherein the fastener includes a bolt, lock nut and two washers.

14. A method from going form a first location at a first height to a second location at a second height comprising the steps of:

lifting a ladder into the air;

holding the ladder having ladder shoes attached to side rails of the ladder at the bottom thereof, said ladder shoes each having a spur plate and a base and are movably connected to the side rails such that each shoe can move between a first position where the base is at a first angle with respect to the respective side rail and a second position where the base is at a second angle with respect to the respective side rail;

moving the ladder shoes about the bottom of the respective side rails until they are fixedly maintained in an intermediate position where the base is at an intermediate angle between the first angle and second angle;

positioning the ladder over a desired support surface;

displacing the ladder shoes while holding the ladder above the support surface so that they fall from the intermediate position;

lowering the ladder towards the support surface such that the ladder shoes move to the first position in which the ladder is supported on the support surface through the base of the ladder shoe;

lifting the ladder into the air;

moving the ladder shoes about the bottom of the side rails until they are maintained in the intermediate position;

positioning the ladder over a desired location of a penetrable support surface; and lowering the ladder downward towards the penetrable surface such that the spur plates move the ladder shoes into the second position and penetrate into the penetrable surface.

15. A ladder shoe for providing enhanced traction between a ladder and a variety of surfaces comprising:

a shoe body having a first side plate, a second side plate and abase, said first side plate and said second side plate attached to the base, the side plates having curved slots through which a fastener is disposed which movably connects the shoe body to an end of a ladder's side rail, thereby allowing the shoe body to move between a first position and a second position, each slot having a notch in which the fastener catches causing the shoe body to be maintained in an intermediate position until the shoe body is desired to be placed into another position, said slot having a first side which is closer to the base than a second side of the slot and said notch disposed on said second side.

16. A ladder shoe as described in claim 15 wherein the bottom of the base includes a footpad fixedly attached to the base which provides a slip resistant surface for engaging the shoe body to essentially flat surface when the shoe body is moved to a first position.

17. A ladder shoe as described in claim 16 wherein a spur plate is fixedly attached to the base for engaging with penetrable surfaces when the shoe body is moved to a second position.

* * * * *

UNITED STATES PATENT AND TRADEMARK OFFICE

CERTIFICATE OF CORRECTION

PATENT NO. : 5,154,255

DATED : October 13, 1992

INVENTOR(S) : Stanley A. Kiska, Richard P. Sulecki

It is certified that error appears in the above-identified patent and that said Letters Patent is hereby corrected as shown below:

Column 2, line 27, replace "form" with -- from -- .

Column 3, line 49, replace "cf" with -- of -- .

Column 5, lines 51-52, replace "a second angel with respect to" with -- an intermediate angle between -- .

Column 5, line 63, replace "firs" with -- first -- .

Column 8, line 8, replace "abase" with -- a base -- .

Signed and Sealed this

Fifth Day of October, 1993

*Attest:*

Bruce Lehman

BRUCE LEHMAN

*Attesting Officer*

*Commissioner of Patents and Trademarks*